US006645057B2

(12) United States Patent
Quek

(10) Patent No.: US 6,645,057 B2
(45) Date of Patent: Nov. 11, 2003

(54) ADJUSTABLE AND EXTENDED GUIDE RINGS

(75) Inventor: Sebastian Ser Wee Quek, Singapore (SG)

(73) Assignee: Chartered Semiconductor Manufacturing Ltd., Singapore (SG)

( * ) Notice: Subject to any disclaimer, the term of this patent is extended or adjusted under 35 U.S.C. 154(b) by 49 days.

(21) Appl. No.: 09/804,725

(22) Filed: Mar. 14, 2001

(65) Prior Publication Data

US 2001/0041521 A1 Nov. 15, 2001

Related U.S. Application Data

(62) Division of application No. 09/354,853, filed on Jul. 29, 1999, now Pat. No. 6,206,768.

(51) Int. Cl.[7] ..... B24B 5/00
(52) U.S. Cl. ..... 451/287; 451/398; 451/285
(58) Field of Search ..... 451/41, 283–290, 451/384, 385, 397, 398, 402

(56) References Cited

U.S. PATENT DOCUMENTS

| | | | | |
|---|---|---|---|---|
| 5,423,716 A | | 6/1995 | Strasbaugh | 451/388 |
| 5,584,751 A | | 12/1996 | Kobayashi et al. | 451/288 |
| 5,624,299 A | * | 4/1997 | Shendon | 451/28 |
| 5,681,215 A | | 10/1997 | Sherwood et al. | 451/388 |
| 5,851,140 A | | 12/1998 | Barns et al. | 451/288 |
| 5,876,272 A | * | 3/1999 | Inaba et al. | 451/285 |
| 5,876,273 A | | 3/1999 | Yano et al. | 451/288 |
| 5,931,725 A | * | 8/1999 | Inaba et al. | 451/288 |
| 5,993,302 A | * | 11/1999 | Chen et al. | 451/285 |
| 6,033,292 A | * | 3/2000 | Inaba | 451/288 |
| 6,196,905 B1 | * | 3/2001 | Inaba | 451/288 |
| 6,276,998 B1 | * | 8/2001 | Sommer et al. | 451/41 |
| 6,319,106 B2 | * | 11/2001 | Numoto | 451/288 |
| 6,368,189 B1 | * | 4/2002 | Maloney et al. | 451/41 |
| 6,413,155 B2 | * | 7/2002 | Matsuo et al. | 451/285 |
| 2001/0000774 A1 | * | 5/2001 | Volodarsky | 451/307 |
| 2001/0010999 A1 | * | 8/2001 | Numoto | 451/8 |
| 2002/0119735 A1 | * | 8/2002 | Nakamura et al. | 451/41 |

* cited by examiner

*Primary Examiner*—M. Rachuba
(74) *Attorney, Agent, or Firm*—George O. Saile; Rosemary L. S. Pike

(57) ABSTRACT

A carrier head is provided that improves the pressure uniformity of a semiconductor wafer against the polishing pad in chemical mechanical polishing (CMP). The carrier head includes a carrier, a carrier film, and a guide ring. The objective of CMP is to provide planarization of the surface of a semiconductor wafer by uniformly removing material. One embodiment of the invention uses independent adjusting screws threaded in the carrier to provide uniform wafer pressure and lengthen guide ring life. The adjusting screws are threaded internally to accept holding screws attached to the guide ring using a backing. This facilitates variation in the spacing between the carrier and guide ring at each adjusting screw. A locking nut on each adjusting screw is used to maintain each gap setting. This embodiment eliminates the need for shims and the associated trial-and-error set-up time in selecting shims. In addition, compensating for guide ring wear can be easily performed without disassembling the carrier head. A second embodiment uses air vents in the carrier, an L-shaped guide ring, and O-rings between the guide ring and carrier. These modifications prevent polishing slurry from being drawn into the point of contact between the carrier and guide ring. If permitted, dried slurry deposits between the guide ring and carrier would cause variations in applied pressure to the wafer during polishing which in turn would result in non-uniform removal of material during CMP.

20 Claims, 4 Drawing Sheets

ADJUSTABLE AND EXTENDED GUIDE RINGS

This is a division of patent application Ser. No. 09/354,853, filing date Jul. 29, 1999, Now U.S. Pat. No. 6,206,768. Adjustable And Extended Guide Rings, assigned to the same assignee as the present invention.

BACKGROUND OF THE INVENTION (1) Field of the Invention

The invention generally relates to a semiconductor wafer carrier and, more particularly to methods of improving the apparatus used in holding the wafer during the polishing process.

(2) Description of Prior Art

Semiconductor fabrication often uses a combination of chemical and mechanical polishing to reduce the thickness and planarize a thin film coating on a wafer. Typically, the wafer is placed in a polishing head and makes contact with a rotating polishing pad having a slurry applied thereto. Often the polishing head holding the wafer also rotates making the planarization process more uniform.

FIG. 1 and FIG. 2 schematically show a cross section of the current art for the polishing process. The wafer 14 is held in place laterally by the guide rings 20. To facilitate thin film planarization, uniform pressure is applied mechanically from above to the carrier 18 holding the wafer 14 firmly against the polishing pad 12. To aid in maintaining uniform pressure to the wafer 14, a thin carrier film 16 is usually attached to the carrier 18. The polishing table 10 and polishing pad 12 are rotated at a set speed, while often, the carrier 18, carrier film 16, and wafer 14 rotate at a second set speed. During automated loading and unloading, the wafer is held onto the carrier by vacuum pressure via passages 22.

The current practice uses plastic or metal shims to set the gap between the guide ring and carrier. This ensures that the wafer stays under the carrier during chemical mechanical polishing (CMP). The shim thickness is not adjustable around the circumference of the guide ring and because of variation in the shim thickness and uneven wear rate on the guide ring, non-uniform pressure may be applied to the wafer. This compromises the process quality by unevenly removing the thin film material during CMP. Operating cost also increase since the guide ring must be reconditioned or discarded when it no longer meets specifications.

A vacuum is used to remove the wafer from the polishing table after completing the CMP process. During this removal process, the vacuum may also draw polishing slurry into the point of contact between the carrier and guide ring. Slurry in this area will cause the guide ring to be out of tolerance, a problem that is exacerbated if the slurry is permitted to dry. Since the slurry does not evenly fill the gap, this also inhibits uniformity of pressure applied during wafer polishing.

Other approaches attempt to address problems in maintaining uniform pressure across the surface of the wafer during polishing. U.S. Pat. No. 5,681,215 to Sherwood et al. teaches a method using multiple bellows forming two pressure chambers. One chamber is used to apply an even load across the wafer and the other is used to press the retaining ring and wafer against the polishing pad. U.S. Pat. No. 5,876,273 to Yano et al teaches a method using a pressure-absorbing member between the carrier and guide ring. This member allows movement of the guide ring with respect to the carrier while maintaining uniform pressure on the wafer. U.S. Pat. No. 5,584,751 to Kobayashi et al teaches a method whereby pressure is applied to a diaphragm allowing the position of the wafer and carrier to be adjusted during the CMP process. U.S. Pat. No. 5,423,716 to Strasbaugh teaches a method of holding the wafer during loading and unloading using negative pressure on a flexible membrane. This creates small suction cups in the membrane, holding the wafer in place. By applying positive pressure to the membrane, the wafer can be released, or, during CMP, held with uniform pressure against the polishing pad. U.S. Pat. No. 5,851,140 to Barns et al. teaches a method using a flexible carrier plate providing an air pillow that maintains uniform pressure on the wafer during CMP.

SUMMARY OF THE INVENTION

A principal object of the present invention is to provide an improved mechanism for carrying semiconductor wafers during polishing.

A second object of the present invention is to provide a carrier mechanism, which applies uniform pressure on the wafer during polishing. This will result in even planarization of thin film semiconductor material.

A further object of the present invention is eliminating the use of shims between the guide rings and carrier, and the associated costs of shim selection and installation.

Another object of the present invention is the prevention of slurry from penetrating the point of contact between the guide ring and carrier. Eliminating this slurry build-up allows the wafer to be held with more uniform pressure against the polishing pad.

Another object of the present invention is the increase in the useable life and reduction in reconditioning costs in the guide rings.

A still yet further object of the present invention is the reduction in setup time required to compensate for guide ring wear.

These objects are achieved by two improvements over the present wafer carrier head. The first improvement uses a plurality of adjusting screws spaced evenly along the circumference of the carrier. The adjusting screws allow the wafer to be positioned flatly against the polishing pad, eliminating the necessity for shims between the guide ring and carrier film. The second improvement uses an L-shaped guide ring fitted with O-ring gaskets and a carrier with air vents. The combination of the air vents, the L-shaped guide ring and the O-rings prevent slurry from being drawn in the contact point between the carrier and guide ring. Allowing slurry to penetrate this contact point would cause the wafer to be misaligned, resulting in non-uniform removal of material during CMP.

BRIEF DESCRIPTION OF THE DRAWINGS

In the accompanying drawings forming a material part of this description, there is shown:

FIG. 1 shows an overall representation of the CMP mechanism, while FIG. 2 shows a typical carrier head assembly.

DESCRIPTION OF THE PREFERRED EMBODIMENTS

Figure 1:
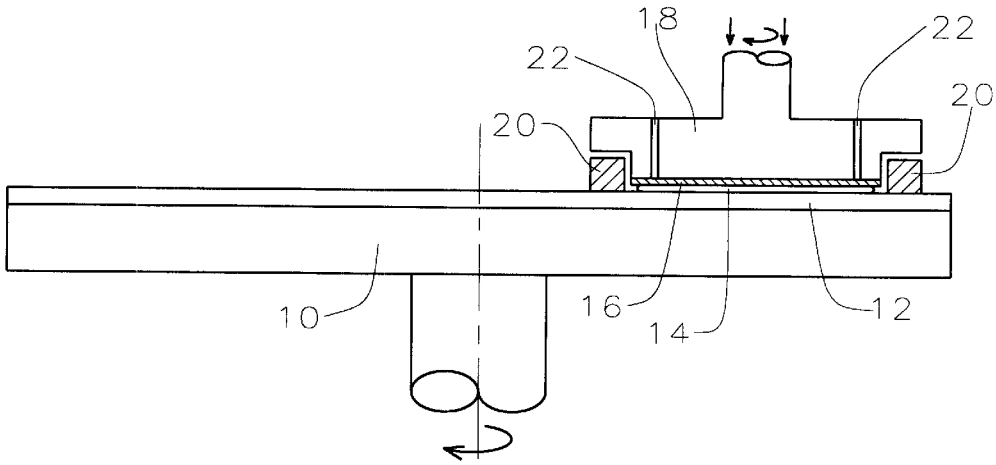
FIG. 1 Prior Art
FIGS. 1 and 2 schematically illustrate in cross-section a schematic representation of prior art in CMP.
Figure 2:
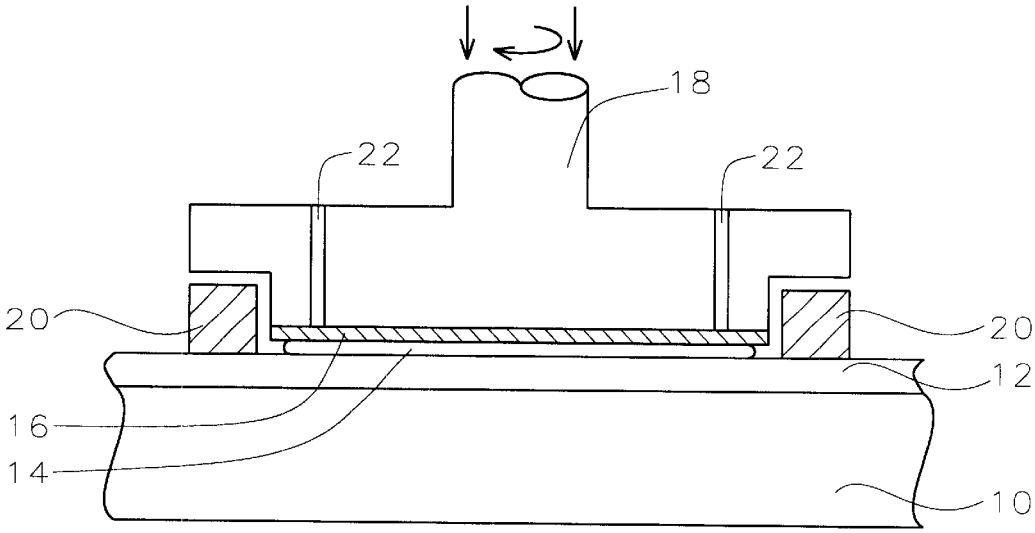
FIG. 2 Prior Art
Figure 3A:
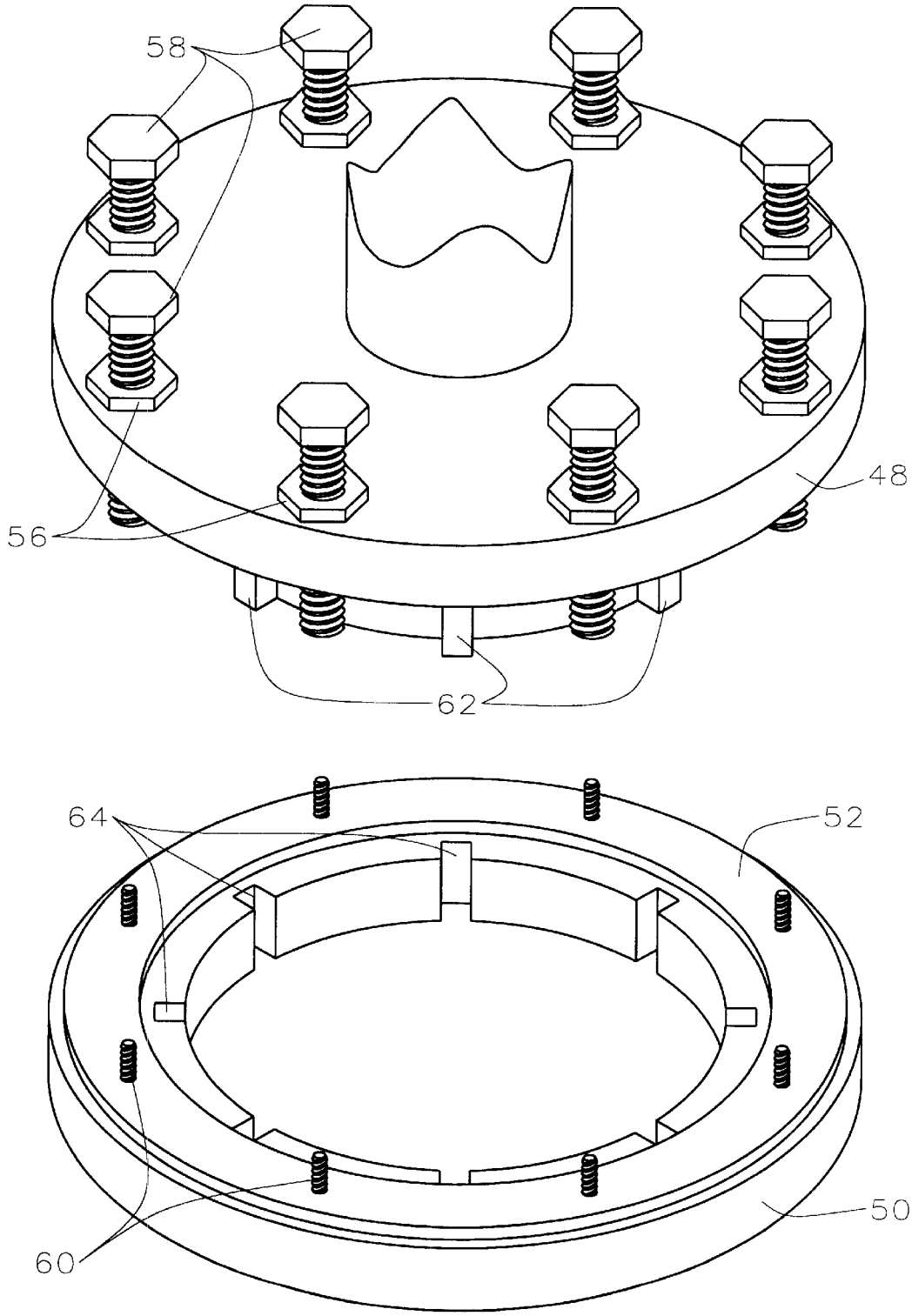
FIGS. 3*a*, 3*b* and 3*c* show the carrier head assembly of one embodiment of the present invention where adjusting screws are used to replace the shims.
Figure 3B:
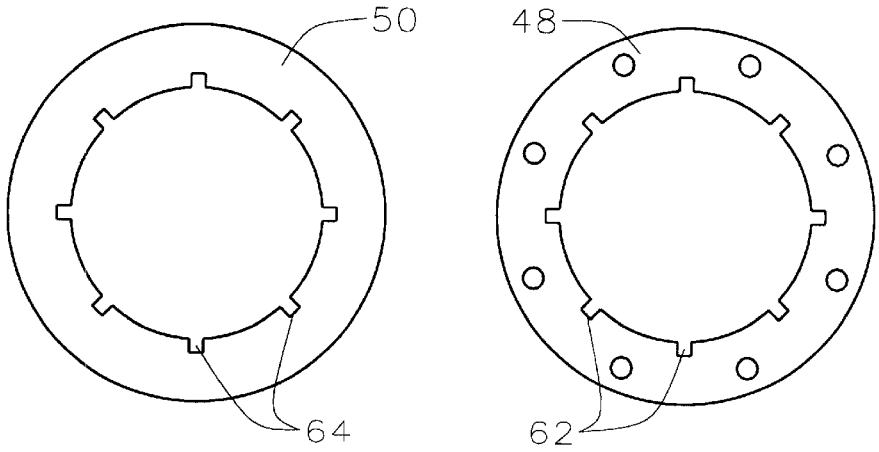
Figure 3C:
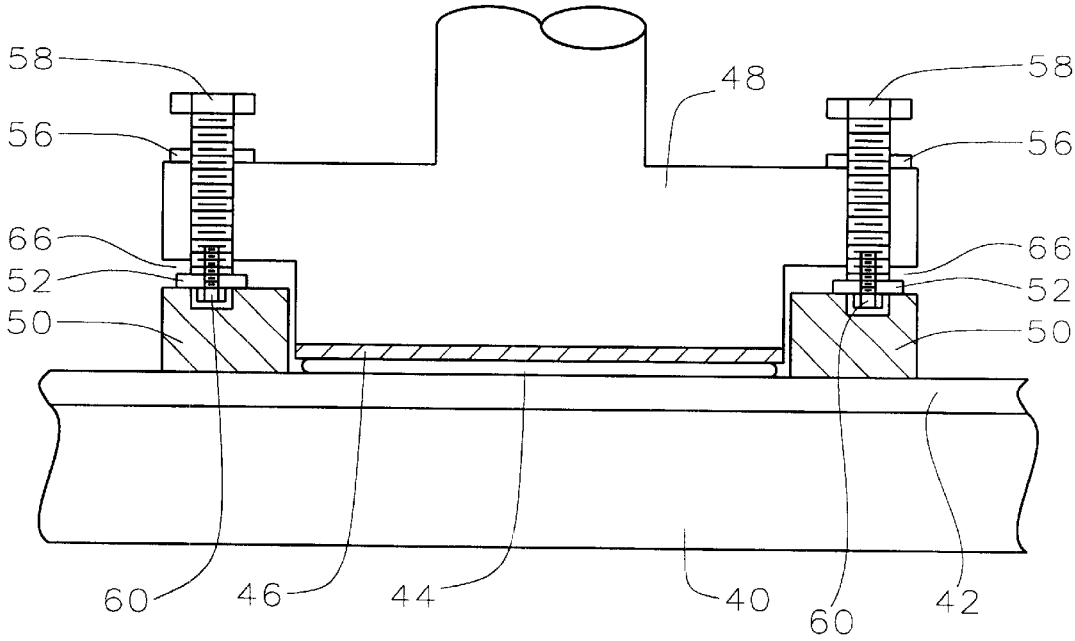

Referring now more particularly to FIGS. 3*a*, 3*b* and 3*c*, there is shown one embodiment of the present invention.

FIG. 3*a* shows a plurality of adjusting screws 58 evenly spaced just inside the circumference of the carrier 48. It is to be understood that the number of adjusting screws 58 could be varied and could number as few as three. Referring now to the guide ring 50 in FIG. 3*a*, a backing plate 52 is attached along the top surface of the guide ring 50 using a plurality of counter sunk screws (not shown). The location of the countersunk screws is not critical except that they should not interfere with the point of contact between the adjusting screws 58 and backing plate 52. The guide ring 50 has cavities (not visible in this figure) to accept the heads of holding screws 60. The adjusting screws 58 are threaded to accept the holding screws 60 when assembled, thus attaching the carrier 48 to the backing plate 52 and guide ring 50. Adjusting screws 58 can then be turned independently to vary the gap (not shown in this figure) between the carrier 48 and guide ring 50. This reduces set-up time for the process by eliminating the need for trial-and-error shim selection.

Referring now to FIG. 3*b*, shown here are bottom views of the carrier 48 and guide ring 50. Notice that the carrier 48 and guide ring 50 have a plurality of mating teeth 62 and grooves or slots 64, respectively. The teeth 62 and grooves or slots 64 prevent rotation between the carrier 48 and guide ring 50 when assembled. The shape of the teeth 62 and grooves or slots 64 may be straight or dove tailed.

Referring now to FIG. 3*c*, there is shown a cross section of the assembled carrier head and polishing table 40. The table 40 is covered by a pad 42 to which polishing slurry (not shown) is applied. During the CMP process the table 40 and pad 42 are rotated at a fixed speed. The guide ring 50 is placed in a concentric groove or notch in the carrier 48. The wafer 44 is contained laterally by the guide ring 50 during polishing. A carrier film 46 is affixed to the underside of the carrier 48. Pressure is applied to the wafer 44 from the carrier 48 through the carrier film 46. The purpose of the carrier film 46 is to absorb any imperfections in the carrier 48 and thus apply uniform pressure to the wafer 44. The pressure of the wafer 44 against the pad 42 containing the slurry results in the removal of the thin semiconductor film. Adjusting screws 58 pass through locking nuts 56 and threaded holes in the carrier 48. Holding screws 60 are placed threaded end upwards through holes in a backing plate 52. The heads of the holding screws 60 are fitted into cavities in the guide ring 50 and the backing plate 52 is then attached to the guide ring 50 using a plurality of countersunk screws (not shown). When the carrier head is assembled, the adjusting screw 58 is mated to the holding screw 60 allowing the gap 66 between the upper surface of the backing plate 52 and the lower mating surface on the carrier 48 to be adjusted at each of the adjusting screw 58 locations. Once the desired height of the gap 66 is achieved, the locking nut 56 is tightened to prevent movement of the adjusting screw 58.

Independently adjusting the gap 66 between the carrier 48 and backing plate 52 along the circumference of the guide ring 50 has several advantages. First, the need for shims and the trial-and-error gap adjustment associated with shims is eliminated. In addition by using this embodiment of the invention, adjustments required to compensate for wear on the guide ring 50 may be performed without disassembling the carrier head thus reducing maintenance and setup time. Finally, having the lower surface of the guide ring 50 parallel to the bottom surface of the wafer 44, the pressure applied to the wafer 44 will be uniform thereby improving the consistency of material removal during CMP.

Figure 4A:
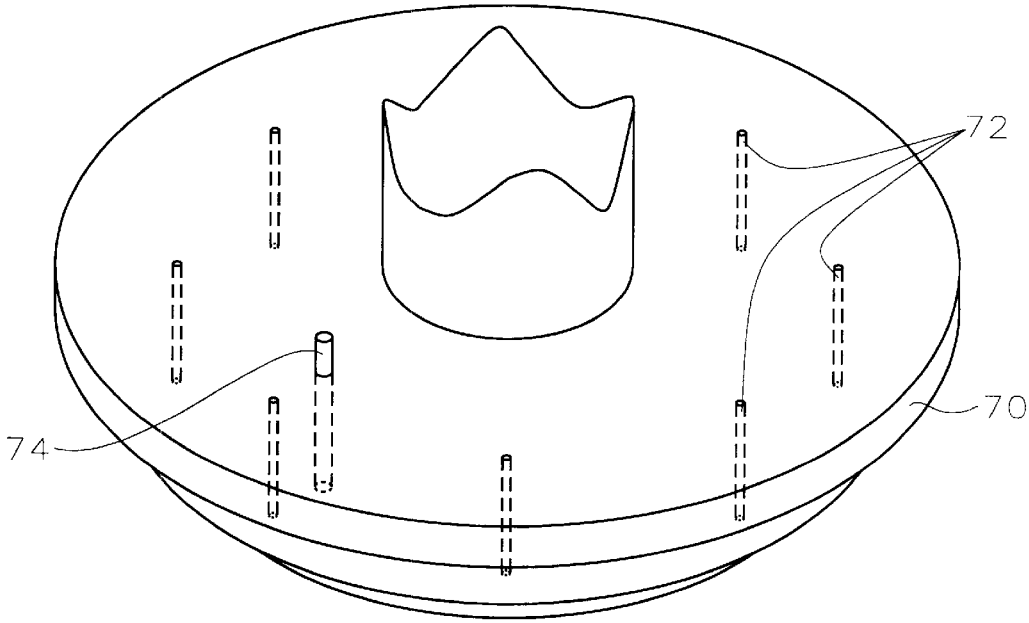
FIGS. 4*a*, and 4*b* shows the carrier head assembly of a second embodiment of the present invention using an L-shaped guide ring with O-rings and a carrier with air vents.
Figure 4B:
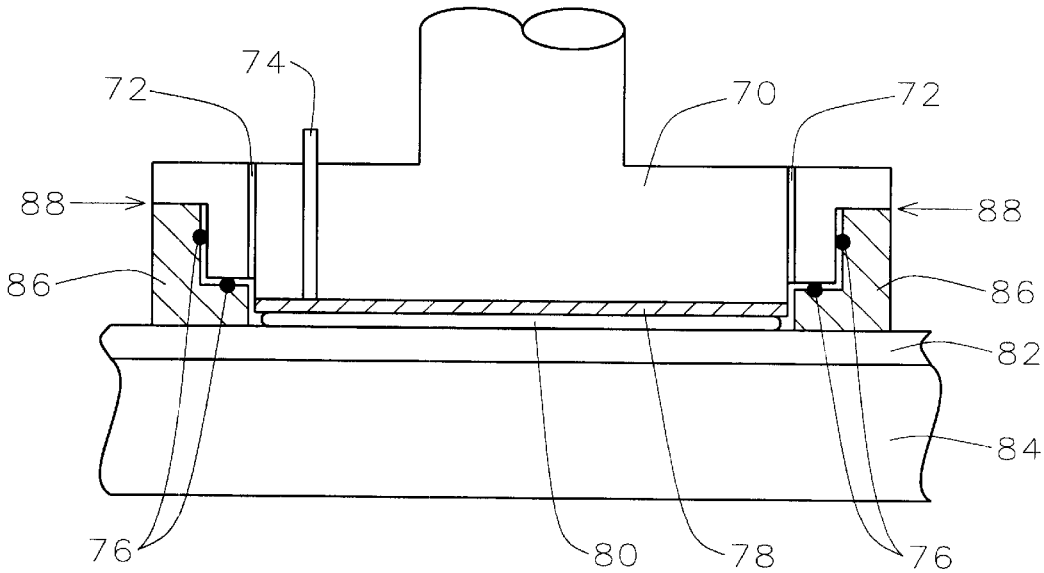

Referring now to FIGS. 4*a* and 4*b*, there is shown a second embodiment of the present invention. This embodiment of the carrier head prevents slurry from entering the contact point of the carrier and guide ring. Referring more particularly to FIG. 4*a* showing a carrier 70 with a plurality of evenly spaced air vents 72. The number of air vents 72 may number from three to twelve. Also shown on the carrier 70 is the vacuum port 74. Referring now to FIG. 4*b*, there is shown a cross section of the completed carrier head and polishing table 84. The table 84 is covered by a pad 82 to which polishing slurry (not shown) is applied while the table 84 and pad 82 are rotated at a fixed speed. The L-shaped guide ring 86 is placed in a concentric groove or notch in the carrier 70. A carrier film 78 is affixed to the bottom surface of the carrier 70 absorbing any imperfection in lower surface of the carrier 70. Pressure is applied to the wafer 80 from the carrier 70 through the carrier film 78. In this embodiment, the wafer 80 is contained laterally by a guide ring 86 during polishing. The positions of the air vents 72 are such that they coincide with the inner circumference of the guide ring 86. When negative pressure is applied to vacuum port 74, rather than drawing slurry up from the polishing pad 82, air will travel downward through the air vents 72. O-rings 76 also prevent slurry from penetrating the contact point 88 between the carrier 70 and guide ring 86. The O-rings 76 may be part of either the guide ring 86 or carrier 70. If the O-ring is part of the guide ring 86, then the carrier 70 will be grooved to accommodate the O-ring 76. Conversely, if the O-ring is part of the carrier 70, then the guide ring 86 will be grooved to accommodate the O-ring 76.

This embodiment has the advantage of keeping slurry from entering the contact point 88 between the carrier 70 and the top surface of the guide ring 86. This is accomplished by three methods. First, the L-shape of guide ring 86 creates a lip inhibiting slurry from reaching its top surface. Second, the air vents 72 allow air to be drawn toward the vacuum port 74 from above the carrier 70, rather than drawing slurry from the polishing pad 82 below the wafer 80. Finally, slurry is kept from reaching the contact point 88 between the carrier 70 and top surface of the guide ring 86 by O-rings placed between them.

While not specifically shown, both of the two embodiments of this invention could be combined into an improved carrier assembly.

While the invention has been particularly shown and described with reference to the preferred embodiments thereof, it will be understood by those skilled in the art that various changes in form and details may be made without departing from the spirit and scope of the invention.

What is claimed is:

1. A carrier head for chemical mechanical polishing comprising:

a carrier to press a wafer against a polishing pad containing a polishing slurry;

an L-shaped guide ring placed beneath said carrier in a matching concentric groove in said carrier, holding said wafer beneath said carrier;

a plurality of air vents drilled into said carrier coinciding with an inner circumference of said guide ring;

a vacuum port in said carrier; and a plurality of O-rings lining slots in said guide ring.

2. The carrier head according to claim 1 where said carrier has teeth and said guide ring has corresponding slots locking said carrier to said guide ring during polishing.

3. The carrier head according to claim 1 wherein said carrier has a resilient carrier film affixed to the lower surface of said carrier.

4. The carrier head according to claim 1 wherein said L-shaped guide ring prevents said slurry from penetrating the contact surface between said carrier and said guide ring.

5. The carrier head according to claim 1 wherein said O-rings rings prevent said slurry from penetrating the contact surface between said carrier and said guide ring.

6. The carrier head according to claim 1 wherein vacuum from said vacuum port will cause air from above said carrier to be drawn through said air vents rather than pulling slurry off from said polishing pad, thus preventing said slurry from penetrating the contact surface between said carrier and said guide ring.

7. The carrier head according to claim 1 wherein said air vents number between three and twelve.

8. A carrier head for chemical mechanical polishing comprising:

a carrier to press a wafer against a polishing pad containing a polishing slurry;

an L-shaped guide ring placed beneath said carrier in a matching concentric groove in said carrier, holding said wafer beneath said carrier;

a plurality of air vents drilled into said carrier coinciding with an inner circumference of said guide ring;

a vacuum port in said carrier; and a plurality of O-rings lining slots in said carrier.

9. The carrier head according to claim 8 where said carrier has teeth and said guide ring has corresponding slots locking said carrier to said guide ring during polishing.

10. The carrier head according to claim 8 wherein said carrier has a resilient carrier film affixed to the lower surface of said carrier.

11. The carrier head according to claim 8 wherein said L-shaped guide ring prevents said slurry from penetrating the contact surface between said carrier and said guide ring.

12. The carrier head according to claim 8 wherein said O-rings rings prevent said slurry from penetrating the contact surface between said carrier and said guide ring.

13. The carrier head according to claim 8 wherein said vacuum will cause air from above said carrier to be drawn through said air vents rather than pulling slurry off from said polishing pad, thus preventing said slurry from penetrating the contact surface between said carrier and said guide ring.

14. The carrier head according to claim 8 wherein said air vents number between three and twelve.

15. A carrier head for chemical mechanical polishing comprising:

a carrier to press a wafer against a polishing pad containing a polishing slurry;

an L-shaped guide ring placed beneath said carrier in a matching concentric groove in said carrier, holding said wafer beneath said carrier;

a plurality of air vents drilled into said carrier coinciding with an inner circumference of said guide ring;

a vacuum port in said carrier; and a plurality of O-rings lining slots in said guide ring or in said carrier wherein vacuum from said vacuum port will cause air from above said carrier to be drawn through said air vents rather than pulling slurry off from said polishing pad, thus preventing said slurry from penetrating a contact surface between said carrier and said guide ring.

16. The carrier head according to claim 15, where said carrier has teeth and said guide ring has corresponding slots locking said carrier to said guide ring during polishing.

17. The carrier head according to claim 15, wherein said carrier has a resilient carrier film affixed to the lower surface of said carrier.

18. The carrier head according to claim 15 wherein said L-shaped guide ring prevents said slurry from penetrating the contact surface between said carrier and said guide ring.

19. The carrier head according to claim 15 wherein said O-rings rings prevent said slurry from penetrating the contact surface between said carrier and said guide ring.

20. The carrier head according to claim 15 wherein said air vents number between three and twelve.

* * * * *